US005210469A

United States Patent [19]

Kim

[11] Patent Number: 5,210,469

[45] Date of Patent: May 11, 1993

[54] METHOD AND APPARATUS FOR DRIVING A FLAT PANEL DISPLAY

[75] Inventor: Dae-il Kim, Suwon, Rep. of Korea

[73] Assignee: Samsung Electron Devices Co., Ltd., Kyunggi, Rep. of Korea

[21] Appl. No.: 832,902

[22] Filed: Feb. 7, 1992

[30] Foreign Application Priority Data

Sep. 28, 1991 [KR] Rep. of Korea ..... 91-17020

[51] Int. Cl.[5] ..... G09G 3/10

[52] U.S. Cl. ..... 315/169.4; 315/169.1

[58] Field of Search ..... 315/169.1, 169.3, 169.4, 315/324, 334, 337, DIG. 1; 340/775, 776, 805

[56] References Cited

U.S. PATENT DOCUMENTS 4,754,203 6/1988 Murakami ..... 315/169.1 X

*Primary Examiner*—David Mis

*Attorney, Agent, or Firm*—Leydig, Voit & Mayer

[57] ABSTRACT

A method for driving a flat-panel display includes an anode and a cathode intersecting each other and right angles, and a sustaining electrode which is a plate or arranged in the same direction of the cathode or anode as strips, in which the output waveform of a sustaining electrode driving circuit is a first pulse having a predetermined period and generated with an amplitude obtained by subtracting a second voltage from a first voltage. The output waveform of an anode driving circuit is a second pulse which is generated with an amplitude obtained by subtracting a fourth voltage from a third voltage when the output waveform of the sustaining electrode driving circuit represents the second voltage, an then maintaining the fourth voltage, while writing only. The output waveforms of a cathode driving circuit is a third pulse which is sequentially generated with an amplitude obtained by subtracting a sixth voltage from a fifth voltage when the sustaining electrode driving circuit represents the second voltage. A value obtained by subtracting the fifth voltage from the first voltage is greater than a minimum discharge, and smaller than a discharge firing voltage. The method is suitable for achieving higher resolution and can widen the operational margin, which enables excellent memory operation.

14 Claims, 2 Drawing Sheets

METHOD AND APPARATUS FOR DRIVING A FLAT PANEL DISPLAY

BACKGROUND OF THE INVENTION

The present invention relates to a method for driving a flat-panel display, and particularly to a method for driving a memory-type plasma display panel.

Among flat-panel displays, a plasma display panel which is generally a matrix-type display device connected to a column, is driven one line at a time. Thus, as compared with being driven one pixel at a time, the light-emitting time per line increases as much as the product of the number of data lines and the light-emitting time of each data bit, thereby enhancing brightness by extending the light-emitting time. In such display panels, since the device's efficiency of a DC-type color plasma display panel is inferior to a monochrome plasma display panel, its brightness degrades by line at a time driving as the monochrome plasma display panel. As one solution of this problem, methods for extending light emitting time within one field have been suggested, and a "memory system" can be given as an example of one solution. The term, "memory system" refers to the operating system of a plasma display panel which enhance the brightness by prolonging the light-emitting time, wherein once turned on, a cell is on continuously for one field or one subfield. That is, writing and erasing are performed for a vertical scanning period in the plasma display panel of line at a time driving, but the cell turned on during a vertical scanning period is continuously in the "on" state during the following vertical scanning period in the memory system.

Generally, in consideration of the need for high voltage to turn on a display tube, once the display tube is turned on, it can be continuously discharged at a lower voltage.

Here, the DC-type plasma display panel of the memory system will be described in detail. The DC-type panel uses "space charge" different from an AC-type panel which uses "wall charge".

FIG. 1 illustrates the current-to-voltage characteristic graph of a DC memory-type plasma display panel.

In FIG. 1, the dotted line has a negative resistance characteristic, and the memory of the DC-type plasma display panel starts to be operated by this characteristic. In more detail, when a cell having the characteristics shown in FIG. 1 is in the "off" state, it is turned on by a voltage greater than a discharge firing voltage $V_B$. In contrast, when the cell is in the "on" state, it is turned off by a voltage below a minimum discharge sustaining voltage Vs. That is, the cell which goes over discharge firing voltage $V_b$ stays "on" state by applying a voltage V (provided that $Vs<V<V_B$). By continuously applying this voltage, cells are capable of being controlled to maintain their on/off state. In addition, the turned-off cell can be turned on by applying a greater voltage than discharge firing voltage $V_B$.

By the way, the above-referenced voltage ($Vs<V<V_B$) is pulsed, because when a plurality of cells are simultaneously driven by the constant voltage under unloading state, excessive current flows, and when each cell carries a load, its efficiency is inferior to pulse discharge, and too much power is consumed. Also, writing and erasing become impossible.

FIG. 2A is a DC-type memory system, which represents the system of NHK Technological Institute of Japan.

Here, an auxiliary anode Al is arranged with a main anode $A_2$ on the identical plane, so one auxiliary discharge cell $C_1$ supplies priming particles to two display discharge cells $C_2$. A constant current source is connected to auxiliary anode $A_1$.

FIG. 2B illustrates the output waveform of driving circuit shown in FIG. 2A, of which operation is described below.

In accordance with the sequential scanning of cathodes K, auxiliary discharge cell $C_1$ is discharged, so that the priming particles are always able to be supplied at the main discharge space. At this time, if the writing is carried out by generating the main discharge, the cell is discharged by allowing cathode $K_1$ to load a writing pulse before a sustaining pulse. After that, since the sustaining pulse is continuously applied, the discharge also continues. Here, the sustaining pulse and scanning pulse do not overlap each other, whereby the cell in which the writing discharges once, continuously discharges, and the cell which has no writing discharge also remains unlighted.

That is, auxiliary anode $A_1$ is for supplying the priming particles, main anode $A_2$ is for writing and sustaining, and cathode K is for writing and erasing.

Therefore, the following problems occur.

First, auxiliary discharge cell $C_1$, unnecessary to write, and display discharge cell $C_2$ are arranged on the same plane, which is unsuitable for achieving higher resolution.

Second, since main anode $A_2$ performs not only a writing operation but also one of sustaining, the increase of the line resistance of main anode $A_2$ causes a problem. This is because all cathodes beneath the main anode are turned on in the memory-type, and thus too much current flows toward a main anode to cause a voltage-drop and the operational margin is decreased. Practically, indium-tin oxide and nickel cause such a problem due to their great line resistance, and although the resistance of gold or silver is good enough, a short may occur due to mercury.

Third, when a plurality of cells below a single anode are turned on, the output impedance of the driving circuit should be low, and its driving waveform is also complicated.

SUMMARY OF THE INVENTION

It is the object of the present invention to provide a method for driving an improved flat-panel display suitable for achieving higher resolutions.

To achieve the above-described object, there is provided a method for driving a flat-panel display comprising an anode and a cathode intersecting each other at a right angle, a sustaining electrode which is a plate or arranged in the same direction of the cathode or the anode as strips, an anode driving circuit for driving the anode, a cathode driving circuit for driving the cathode, and a sustaining electrode driving circuit for driving the sustaining electrode, wherein the output waveform of the sustaining electrode driving circuit is a pulse which is generated with an amplitude obtained by subtracting a second voltage from a first voltage, and then the pulse having a predetermined period drops to the second voltage;

the output waveform of the anode driving circuit is a pulse which is generated with an amplitude obtained by subtracting a fourth voltage from a third voltage when the output waveform of the sustaining electrode driving circuit represents the second voltage, and then maintaining the fourth voltage, while writing only;

the output waveforms of the cathode driving circuit is a pulse which is sequentially generated with an amplitude obtained by subtracting a sixth voltage from a fifth voltage when the sustaining electrode driving circuit represents the second voltage;

a voltage for starting discharge has a value that the value obtained by subtracting the sixth voltage from the third voltage is greater than a discharge firing voltage; and a voltage which keeps a discharged cell continuously being discharged and the other cell without discharging another cell, maintaining that cell unlighted, has a value obtained by subtracting the fifth voltage from the first voltage. This value is greater than a minimum discharge and smaller than the discharge firing voltage.

BRIEF DESCRIPTION OF THE DRAWINGS

The above objects and other advantages of the present invention will become more apparent by the following description in reference to accompanying drawings, in which.

DETAILED DESCRIPTION OF THE INVENTION

Figure 1:
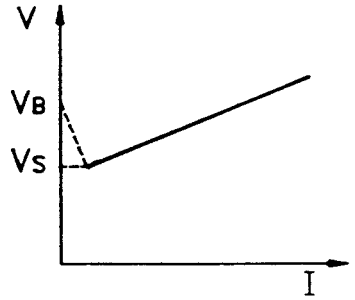
FIG. 1 (PRIOR ART)
FIG. 1 shows the current-to-voltage characteristic of a DC memory type plasma display panel's driving circuit.
Figure 2A:
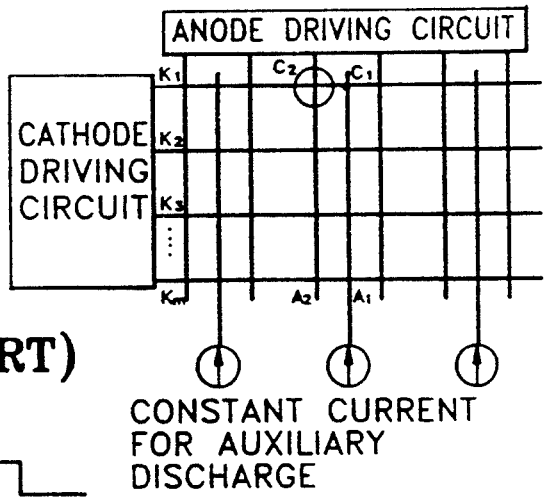
FIG. 2A (PRIOR ART)
FIG. 2A shows the electrode arrangement and electrode driving circuit of a conventional flat-panel display.
Figure 2B:
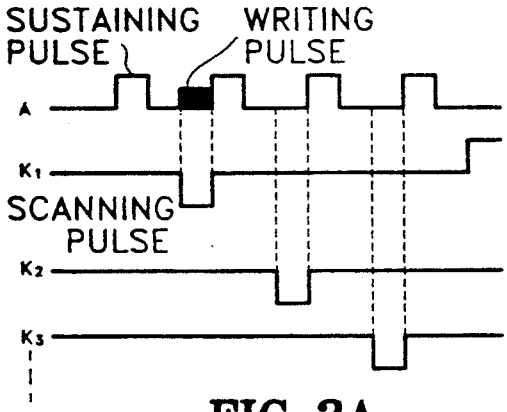
FIG. 2B(PRIOR ART)
FIG. 2B is the output waveform diagram of the driving circuit of FIG. 1.
Figure 3B:
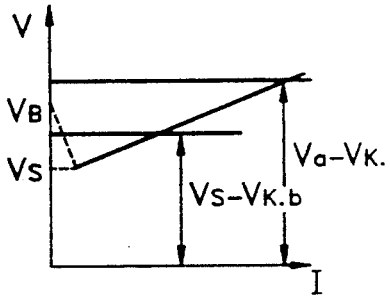
FIG. 3B shows the current-to-voltage characteristic of the driving circuit shown in FIG. 3A.
Figure 3A:
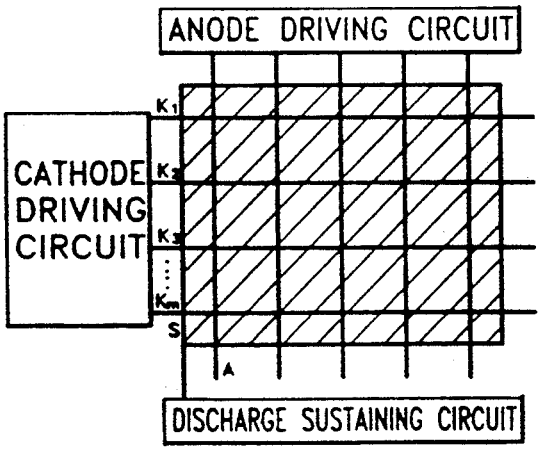
FIG. 3A shows the electrodes arrangement and electrode driving circuit of a flat-panel display according to the present invention.

FIG. 3A illustrates the electrode arrangement and electrode's driving circuit of a flat-panel display according to the present invention.

An anode A and a cathode K are arranged to intersect each other at right angles, and a sustaining electrode S forms a plane which completely covers a cell. Also, if sustaining electrode S is stripe-shaped in FIG. 3A, it parallels either anode A or cathode K.

FIG. 3B shows the driving circuit's current-to-voltage characteristic of anode A, cathode K, and sustaining electrode S, illustrated in FIG. 3A.

The discharge occurs by setting the display discharge voltage such that the value obtained by subtracting a cathode voltage Vk from an anode voltage Va becomes greater than a discharge firing voltage $V_B$. The value obtained by subtracting a cathode bias voltage from discharge sustaining voltage Vs is set higher than a minimum sustain voltage and lower than discharge firing voltage $V_B$, so that once the cell is discharged, it is continuously discharged, and the other cell remains unlit without discharging.

Figure 3C:
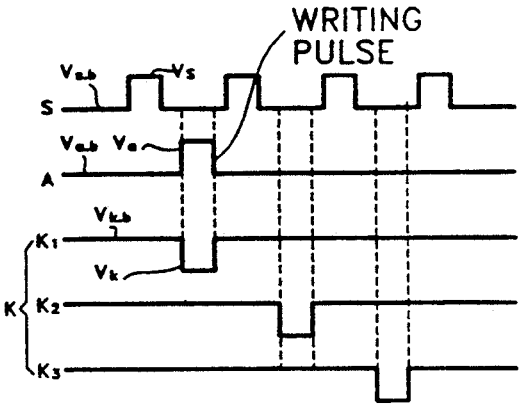
FIG. 3C is the output waveform diagram of the driving circuit shown in FIG. 3A.

FIG. 3C represents the timing of the driving circuit's output waveform of anode A, cathode K, and sustaining electrode S, illustrated in FIG. 3A.

The driving circuit of sustaining electrode S outputs a waveform with a period of 4–8 μsec and an amplitude which is obtained by subtracting discharge sustaining bias voltage Vs.b from discharge sustaining voltage Vs. While writing only, the anode driving circuit outputs a waveform with an amplitude which is obtained by subtracting an anode bias voltage Va.b from an anode voltage Va, during the period when discharge sustaining voltage Vs.b appears in the output waveform of sustaining electrode driving circuit. The cathode driving circuit outputs a waveform with an amplitude which is obtained by subtracting a cathode voltage $V_K$ from a cathode bias voltage $V_K$.b, and has the same period as the output waveform of anode driving circuit. In addition, the cathode driving circuit's output waveforms $K_1$, $K_2$, $K_3$ . . . , and Km are sequentially output at the timing represented by discharge sustaining voltage Vs.b of sustaining electrode driving circuit's output waveform. The timing operation of cathode K is represented by the cathode driving circuit's output waveforms $K_1$, $K_2$, $K_3$ . . . , and Km, by an interval of 4–8 μsec determined by the gray scale. At this time, when a writing pulse is applied to anode A, the corresponding cell is discharged. Even if the cathode successively goes into the scanning "off" state, since the value subtracting cathode bias voltage $V_K$.b from discharge sustaining voltage Vs is constantly applied to the cell through the sustaining electrode, the cell is continuously discharged until an erasing pulse is applied to cathode K. Therefore, the memory is realized.

Figure 4A:
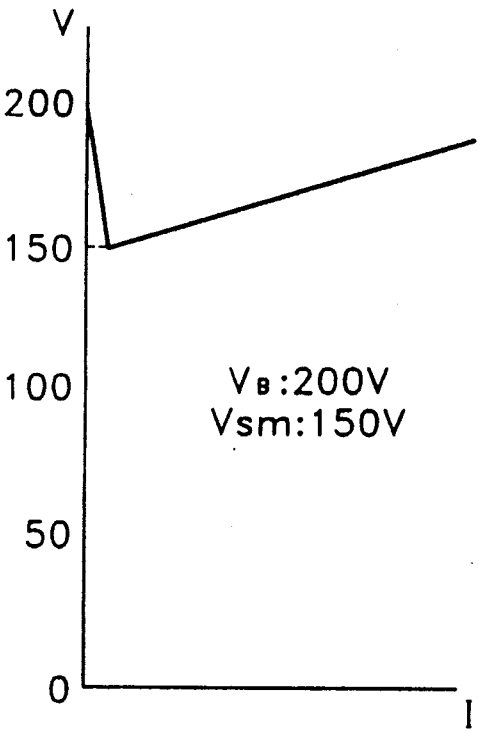
FIG. 4A shows the specific current-to-voltage characteristic of the driving circuit shown in FIG. 3A.

FIG. 4A illustrates the specific voltage values of the current-to-voltage graph shown in FIG. 3B.

Figure 4B:
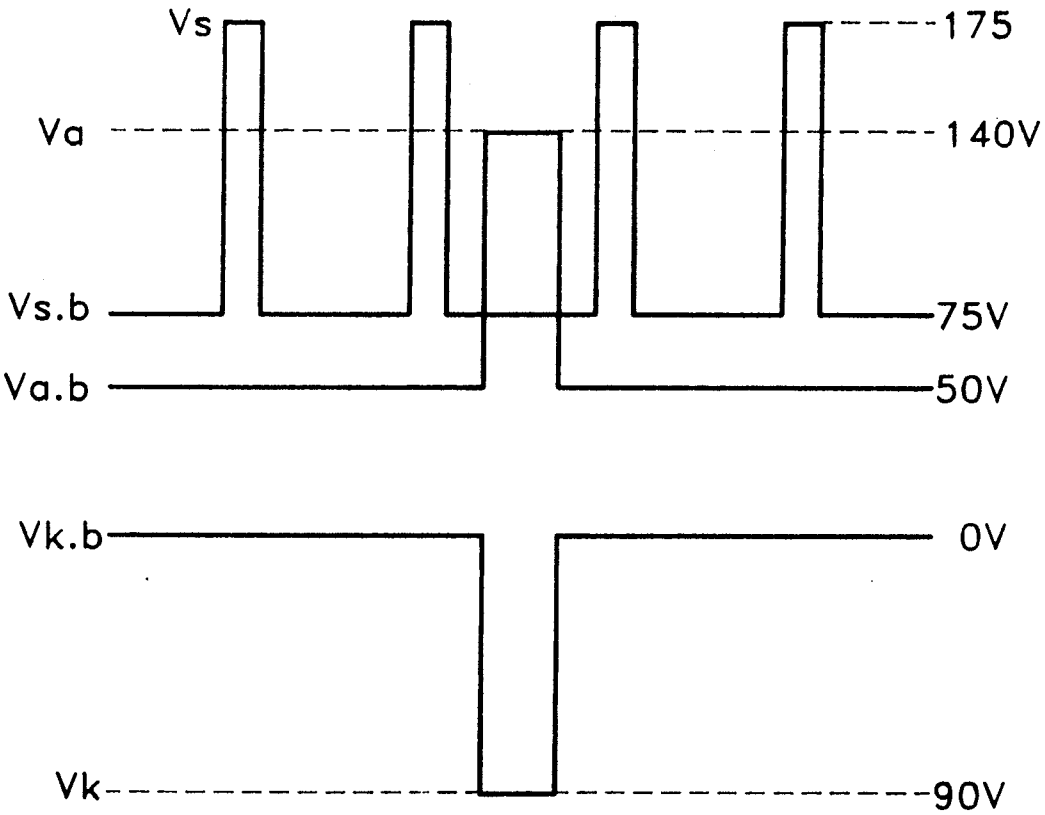
FIG. 4B is the output waveform diagram of the driving circuit shown in FIG. 3A.

FIG. 4B illustrates the specific voltage of values of the waveform shown in FIG. 3C.

As a result, the DC memory-type plasma display panel according to the present invention has the advantages as follows.

First, since auxiliary discharge cell $C_1$ is useless, this plasma display panel is suitable for achieving higher resolutions.

Second, by separating the operation of writing and sustaining, a material can be selected as an electrode among various materials including such as indium-tin-oxide (ITO) and whose transmittivity is good enough for a display electrode.

Third, there is no limitation in the material chosen for display anode material, so a low-resistance material can be used, which widens the operational margin. Further, excellent memory operation is also possible.

Fourth, the impedance of anode IC is barely restricted, so that the cost can be reduced, and the small amount of stray capacitance within the panel does not affect the operation.

What is claimed is:

1. A method for driving a flat-panel display which includes an anode driving circuit, a cathode driving circuit, and a sustaining electrode driving circuit comprising the steps of:

generating a pulse waveform from the sustaining electrode driving circuit having a predetermined period and an amplitude obtained by subtracting a second voltage from a first voltage;

generating a pulse waveform from the anode driving circuit having an amplitude obtained by subtracting a fourth voltage from a third voltage when the pulse waveform of the sustaining electrode driving circuit represents the second voltage, and maintaining the fourth voltage while writing only;

generating a pulse waveform form the cathode driving circuit sequentially with an amplitude obtained by subtracting a sixth voltage from a fifth voltage when the sustaining electrode driving circuit represents the second voltage;

selecting a voltage for starting cell discharge having a value obtained by subtracting the sixth voltage from the third voltage, the voltage being greater than a discharge firing voltage; and selecting a voltage which sustains discharge of a discharging cell continuously while maintaining non-discharging cells in a non-discharging state, the voltage having a value obtained by subtracting the fifth voltage from the first voltage, the voltage being greater than a minimum discharge and smaller than the discharge firing voltage.

2. A method for driving a flat-panel display as claimed in claim 1, wherein said first voltage is a discharge sustaining voltage.

3. A method for driving a flat-panel display as claimed in claim 1, wherein said second voltage is a discharge sustaining bias voltage.

4. A method for driving a flat-panel display as claimed in claim 1, wherein said third voltage is an anode voltage.

5. A method for driving a flat-panel display as claimed in claim 1, wherein said fourth voltage is an anode bias voltage.

6. A method for driving a flat-panel display as claimed in claim 1, wherein said fifth voltage is a cathode bias voltage.

7. A method for driving a flat-panel display as claimed in claim 1, wherein said sixth voltage is a cathode voltage.

8. An apparatus for driving a flat-panel display comprising:

a sustaining electrode driving circuit connected to a sustaining electrode, said sustaining electrode driving circuit generating a pulse waveform having a predetermined period and an amplitude obtained by subtracting a discharge sustaining bias voltage from a discharge sustaining voltage;

an anode driving circuit connected to an anode which is arranged in the same direction as the sustaining electrode, said anode driving circuit generating a pulse waveform having an amplitude obtained by subtracting a anode bias voltage from a anode voltage when the pulse waveform of the sustaining electrode driving circuit represents the discharge sustaining bias voltage, said anode driving circuit maintaining the anode bias voltage while writing only; and a cathode driving circuit connected to a cathode, said cathode driving circuit sequentially generating a pulse waveform having an amplitude obtained by subtracting a cathode bias voltage from a cathode voltage when said sustaining electrode driving circuit represents the discharge sustaining bias voltage;

wherein a voltage for starting cell discharge has a value, obtained by subtracting the cathode bias voltage from the anode voltage, which is greater than a discharge firing voltage; and a voltage which sustains discharge of a discharging cell continuously while maintaining non-discharging cells in a nondischarging state has a value, obtained by subtracting the cathode voltage form the discharge sustaining voltage, which is greater than a minimum discharge voltage and smaller than the discharge firing voltage.

9. An apparatus for driving a flat-panel display as claimed in claim 8, wherein the anode and the cathode intersect at right angles.

10. An apparatus for driving a flat-panel display comprising:

a sustaining electrode driving circuit connected to a sustaining electrode, said sustaining electrode driving circuit generating a pulse waveform having a predetermined period and an amplitude obtained by subtracting a discharge sustaining bias voltage from a discharge sustaining voltage;

an anode driving circuit connected to an anode, said anode driving circuit generating a pulse waveform having an amplitude obtained by subtracting a anode bias voltage from a anode voltage when the pulse waveform of the sustaining electrode driving circuit represents the discharge sustaining bias voltage, said anode driving circuit maintaining the anode bias voltage while writing only; and a cathode driving circuit connected to a cathode which is arranged in the same direction as the sustaining electrode, said cathode driving circuit sequentially generating a pulse waveform having an amplitude obtained by subtracting a cathode bias voltage from a cathode voltage when said sustaining electrode driving circuit represents the discharge sustaining bias voltage;

wherein a voltage for starting cell discharge has a value, obtained by subtracting the cathode bias voltage from the anode voltage, which is greater than a discharge firing voltage; and a voltage which sustains discharge of a discharging cell continuously while maintaining non-discharging cells in a non-discharging state has a value, obtained by subtracting the cathode voltage from the discharge sustaining voltage, which is greater than a minimum discharge voltage and smaller than the discharge firing voltage.

11. An apparatus for driving a flat-panel display as claimed in claim 10, wherein the anode and the cathode intersect at right angles.

12. An apparatus for driving a flat-panel display comprising:

a sustaining electrode driving circuit connected to a sustaining electrode, said sustaining electrode driving circuit generating a pulse waveform having a predetermined period and an amplitude obtained by subtracting a discharge sustaining bias voltage from a discharge sustaining voltage;

an anode driving circuit connected to an anode, said anode driving circuit generating a pulse waveform having an amplitude obtained by subtracting a anode bias voltage from a anode voltage when the pulse waveform of the sustaining electrode driving circuit represents the discharge sustaining bias voltage, said anode driving circuit maintaining the anode bias voltage while writing only; and cathode driving circuit connected to a cathode, said cathode driving circuit sequentially generating a pulse waveform having an amplitude obtained by subtracting a cathode bias voltage from a cathode voltage when said sustaining electrode driving circuit represents the discharge sustaining bias voltage;

wherein a voltage for starting cell discharge has a value, obtained by subtracting the cathode bias voltage form the anode voltage, which is greater than a discharge firing voltage; and a voltage which sustains discharge of a discharging cell continuously while maintaining non-discharging cells in a non-discharging state has a value, obtained by subtracting the cathode voltage from the discharge sustaining voltage, which is greater than a minimum discharge voltage and smaller than the discharge firing voltage.

13. An apparatus for driving a flat-panel display as claimed in claim 12, wherein the anode and the cathode intersect at right angles.

14. An apparatus for driving a flat-panel display as claimed in claim 12, wherein the sustaining electrode comprises a plate.

* * * * *

UNITED STATES PATENT AND TRADEMARK OFFICE

CERTIFICATE OF CORRECTION

PATENT NO. : 5,210,469

DATED : May 11, 1993

INVENTOR(S) : Dae-il Kim

It is certified that error appears in the above-identified patent and that said Letters Patent is hereby corrected as shown below:

Claim 8, col. 6, line 2, change "form" to --from--.

Claim 12, col. 6, line 64, before "cathode" (first occurrence) insert --a--.

Claim 12, col. 7, line 5, change "form" to --from--.

Signed and Sealed this

Eighth Day of February, 1994

Bruce Lehman

*Attest:*

BRUCE LEHMAN

*Attesting Officer*

*Commissioner of Patents and Trademarks*